US009815064B2

(12) United States Patent
Hirsch et al.

(10) Patent No.: US 9,815,064 B2
(45) Date of Patent: Nov. 14, 2017

(54) COUNTER TOP FOOD WASTE DISPOSER

(71) Applicant: Emerson Electric Co., St. Louis, MO (US)

(72) Inventors: Nicholas J. Hirsch, Wind Lake, WI (US); Kelly T. Gamble, Waterford, WI (US)

(73) Assignee: Emerson Electric Co., St. Louis, MO (US)

( * ) Notice: Subject to any disclaimer, the term of this patent is extended or adjusted under 35 U.S.C. 154(b) by 697 days.

(21) Appl. No.: 14/277,156

(22) Filed: May 14, 2014

(65) Prior Publication Data

US 2014/0339345 A1 Nov. 20, 2014

Related U.S. Application Data

(60) Provisional application No. 61/824,395, filed on May 17, 2013.

(51) Int. Cl.

| | |
|---|---|
| ***B02C 18/00*** | (2006.01) |
| ***B02C 18/22*** | (2006.01) |
| ***E03C 1/266*** | (2006.01) |

(52) U.S. Cl.

CPC ..... *B02C 18/0092* (2013.01); *B02C 18/2216* (2013.01); *E03C 1/2665* (2013.01)

(58) Field of Classification Search

CPC ..... B02C 18/2216; B02C 18/0092; B02C 18/2265; B02C 18/22; E03C 1/2665

(Continued)

(56) References Cited

U.S. PATENT DOCUMENTS 2,308,917 A * 1/1943 Hardinge ..... B02C 25/00 137/13
2,836,369 A * 5/1958 Strehlow ..... E03C 1/2665 241/100

(Continued)

FOREIGN PATENT DOCUMENTS

| | | | |
|---|---|---|---|
| GB | 2042927 | A | 10/1980 |
| WO | WO-02072271 | A1 | 9/2002 |
| WO | WO-2013151496 | A1 | 10/2013 |

OTHER PUBLICATIONS

International Search Report and Written Opinion of the International Searching Authority for PCT/US2014/038302 dated Jul. 30, 2014.

*Primary Examiner* — Faye Francis
(74) *Attorney, Agent, or Firm* — Harness, Dickey & Pierce, P.L.C.

(57) ABSTRACT

A counter top food waste disposer in accordance with an aspect of the present disclosure includes a food conveying section, a motor section and a grind and discharge section disposed between the food conveying section and the motor section. In an aspect, the food waste disposer also includes a discharge area in which a container is removably receivable. When the container is received in the discharge area, during operation of the food waste disposer food waste is dischargeable from a discharge outlet of a discharge section into the container. In an aspect, a hose is removably receivable in the discharge area when the container is not present and food waste is discharged through the hose when it is received in the discharge area. In an aspect, the food waste disposer includes a water reservoir from which water can be introduced into the food waste disposer.

6 Claims, 4 Drawing Sheets

(58) Field of Classification Search
USPC ..... 241/46.01, 46.02
See application file for complete search history.

(56) References Cited

U.S. PATENT DOCUMENTS

| | | | | |
|---|---|---|---|---|
| 3,094,291 | A | 6/1963 | Lindstrom et al. | |
| 3,207,837 | A | 9/1965 | Brezosky | |
| 3,315,903 | A * | 4/1967 | Vernon | E03C 1/2665 241/285.1 |
| 3,815,833 | A * | 6/1974 | Vliet | B02C 18/148 241/15 |
| 4,337,901 | A * | 7/1982 | Ogura | E03C 1/2665 241/100 |
| 5,340,472 | A * | 8/1994 | Heck | B01D 11/028 209/224 |
| 6,186,426 | B1 * | 2/2001 | Killer | B01J 2/14 241/185.6 |
| 2012/0091244 | A1 | 4/2012 | Loos et al. | |
| 2013/0048768 | A1 | 2/2013 | Berger | |

* cited by examiner

COUNTER TOP FOOD WASTE DISPOSER

CROSS-REFERENCE TO RELATED APPLICATIONS

This application claims the benefit of U.S. Provisional Application No. 61/824,395 filed May 17, 2013. The entire disclosure of this application is incorporated herein by reference.

FIELD

The present disclosure relates generally to food waste disposers, and more particularly, to a counter top food waste disposer.

BACKGROUND

This section provides background information related to the present disclosure, which is not necessarily prior art.

A food waste disposer of the type that is disposed underneath a sink and is mounted to a drain opening of the sink typically includes a food conveying section, a motor section and a grind section. The grind section is disposed between the food conveying section and the motor section. The food conveying section conveys food waste and water to the grind section. The grind section receives and grinds the food waste and the ground food waste is discharged through a discharge opening to a tailpipe.

The grind section typically includes a grind mechanism with a rotating shredder plate assembly and a stationary grind ring. The shredder plate assembly is connected to a shaft of an electric motor of the motor section and includes a shredder plate with one or more lugs, typically one or more pairs of lugs. The lugs may include fixed lugs that are fixed to the shredder plate, rotatable lugs (also called swivel lugs) that are rotatably fastened to the shredder plate and are free to rotate thereon, or both. The shredder plate is rotated relative to the grind ring via the electric motor. The grind ring is typically mounted in a housing and includes multiple spaced teeth.

During operation of the food waste disposer, the food waste that is directed from the food conveying section to the grind section is forced by the lugs against the grind ring to comminute the food waste. When the lugs are swivel lugs, rotation of the shredder plate creates a centrifugal force that acts upon the lugs and enhances comminution of the food waste between the lugs and the grind ring. The sharp edges of the teeth grind the food waste into particulate matter (or ground matter). When the food waste is sufficiently ground, the food waste passes through gaps between the shredder plate and the grind ring and enters a discharge area in an upper end bell as a food waste/water slurry. It is then discharged out a discharge outlet in the upper end bell through a tail pipe to a drain line of household plumbing.

Typically, food waste disposers operate off household power and require access to the household power in the sink cabinet. In a typical installation, the food waste disposer is wired to household power through a wall switch that is used to turn the food waste disposer on and off. Alternatively, when the food waste disposer is a batch feed disposer, the wall switch can be replaced by an activation means located in the stopper used with the batch feed disposer. In another alternative, an air switch mounted on the sink deck or countertop, or wireless remote control, can be used instead of the wall switch to turn the food waste disposer on and off.

One way of disposing of food waste is using a food waste disposer. A problem sometimes faced with existing food waste disposers is that installing a food waste disposer to a sink of a dwelling for the first time can be difficult and relatively expensive due to the need to alter the plumbing under the sink and route electricity under the sink. Many times this is beyond the capabilities of the normal dwelling owner and the installation must then be contracted to a professional further increasing the cost of the installation making it cost prohibitive in some cases. Another problem sometimes faced with existing food waste disposers is that the landlord in the case of rental dwellings may not permit the permanent installation of the food waste disposer. In some cases, the applicable building codes may not allow for the permanent installation of the food waste disposer. In each case, the convenience and hygiene of using a food waste disposer to dispose of food waste may not be readily available if at all.

Composting is another way of dealing with food waste. The decay rate of food waste in a compost pile is influenced by the size of the food waste. If the size of the food waste can be reduced to smaller particles, the food waste will decay faster allowing for a smaller composting area to compost a given amount of food waste. There are presently small hand operated devices available for home use to grind food waste for composting. A problem with these devices is that their capabilities are limited both in the size of the particles to which they can reduce the food waste and the different types of food waste that they can grind, such as their ability to grind hard food waste. Conventional food waste disposers of the type described above have been converted to run outside and discharge into a container. A problem is that this can be be inconvenient, messy and somewhat impractical since most conventional food waste disposers are not designed for outside use.

SUMMARY

A counter top food waste disposer in accordance with an aspect of the present disclosure includes a food conveying section, a motor section and a grind and discharge section disposed between the food conveying section and the motor section. The grind and discharge section has a grind section and a discharge section. In an aspect, the food waste disposer also includes a discharge area in which a container is removably receivable. When the container is received in the discharge area, during operation of the food waste disposer food waste is dischargeable from a discharge outlet of the discharge section into the container.

In an aspect, a hose is removably receivable in the discharge area. When the hose is received in the discharge area the container is not and when the container is received in the discharge area the hose is not. When the hose is received in the discharge area, an upper end of the hose is coupled to a discharge outlet of the discharge section and food waste is dischargeable during operation of the food waste disposer from the discharge outlet and out through the hose.

In an aspect, the food waste disposer also further includes a food waste inlet chute having an outlet opening to the food inlet section of the food waste disposer.

In an aspect, the food waste disposer further includes a water reservoir from which water can be introduced into the food waste disposer.

In an aspect, the food waste disposer further includes a water metering mechanism coupled to the water reservoir. The water metering mechanism is adapted to meter water from the reservoir into the food waste disposer when water is to be introduced from the reservoir into the food waste disposer. In an aspect, the water is introduced into the food inlet section when the water is introduced into the food waste disposer.

In an aspect, a coupling is affixed to the discharge outlet and the hose is removably couplable to the discharge outlet by being removably couplable to an end of the coupling. In an aspect, the coupling is a right angle coupling.

BRIEF DESCRIPTION OF THE DRAWINGS

Other objects and advantages of the invention will become apparent upon reading the following detailed description and upon reference to the drawings in which.

Figure 1:
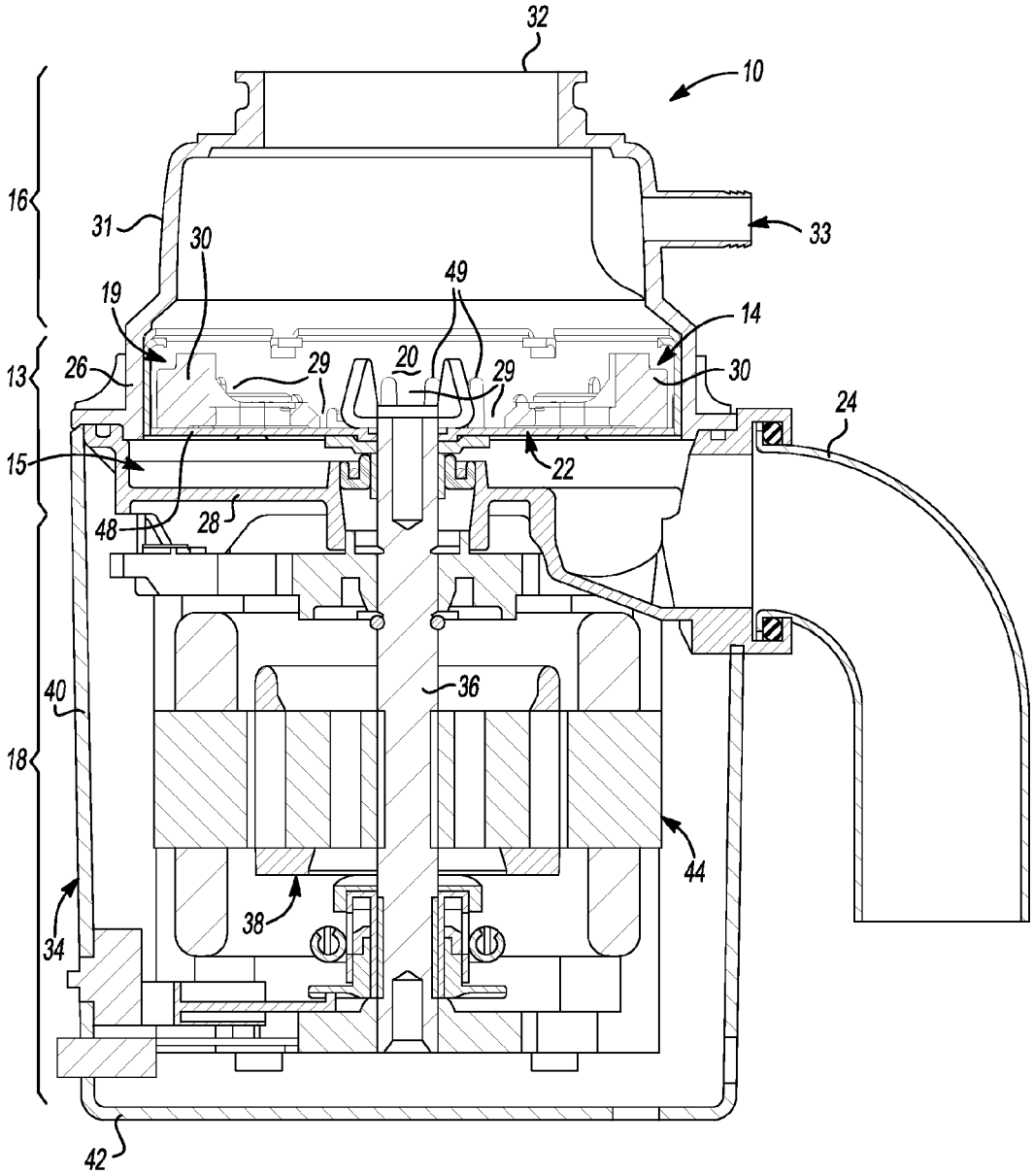
Fig-1 PRIOR ART
FIG. 1 is a perspective view of a prior art food waste disposer accordance with an aspect of the present disclosure.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

In FIG. 1, a prior art food waste disposer 10 is shown. The food waste disposer 10 includes a grind and discharge section 13 disposed between a food conveying section 16 and a motor section 18. The grind and discharge section 13 includes a grind section 14 and a discharge section 15. The grind section 14 includes a grind mechanism 19 with a stationary grind ring 20 and a rotating shredder plate assembly 22. The rotating shredder plate assembly 22 includes a rotatable shredder plate 48 on which lugs 30 are rotatably fastened. Lugs 30 are illustratively swivel lugs, but it should be understood that they could be fixed lugs, or include both swivel lugs and fixed lugs.

The grind section 14 includes a grind housing 26 that encompasses the grind mechanism 19. The grind housing 26 may be fastened to an upper end bell (UEB) 28 of the discharge section 15 and holds the stationary grind ring 20. The stationary grind ring 20 is mounted in a fixed (stationary) position within the grind housing 26. The grind ring 20 includes teeth 29 (which may be edges of gaps 49 in stationary grind ring 20 between teeth 29). The stationary grind ring 20 may be fixedly affixed to an inner surface of the grind housing 26 by an interference fit and may be composed, for example, of galvanized steel.

The food conveying section 16 includes an inlet housing 31 with a first inlet 32. The first inlet 32 receives food waste and water. The inlet housing 31 may be a metal housing or an injection molded plastic housing. The inlet housing 31 also includes a second inlet 33 for receiving water discharged from a dishwasher (not shown). The inlet housing 31 may be integrally formed with the grind housing 26, such as by injection-molding both of the housings 26, 31 as a single component.

The motor section 18 includes a motor 34 having a rotor 38 and a stator 44. Rotor 38 rotates in stator 44 imparting rotational movement to a rotor shaft 36 of a rotor 38. Motor 34 is illustratively an induction motor. It should be understood, that motor 34 may be a permanent magnet DC motor, a brushless DC motor, or a universal motor. The motor 34 is enclosed within a motor housing 40. The motor housing 40 has a lower end frame 42. The rotor shaft 36 is connected to and rotates the shredder plate assembly 22 within the stationary grind ring 20.

During operation of the food waste disposer 10, the shredder plate assembly 22 is rotated by motor 34. Due to the rotation of the shredder plate assembly 22, lugs 30 force the food waste against the teeth 29 of grind ring 20 to grind the food waste into small particulate matter. A slurry of the particulate matter and water passes from the shredder plate assembly 22, outside a periphery of shredder plate 48, through gaps 49 between the teeth 29 to a discharge area below the shredder plate assembly 22 and in the UEB 28. It is then discharged out a discharge outlet of UEB 28 through tailpipe 24 to a drain line (not shown).

Figure 2:
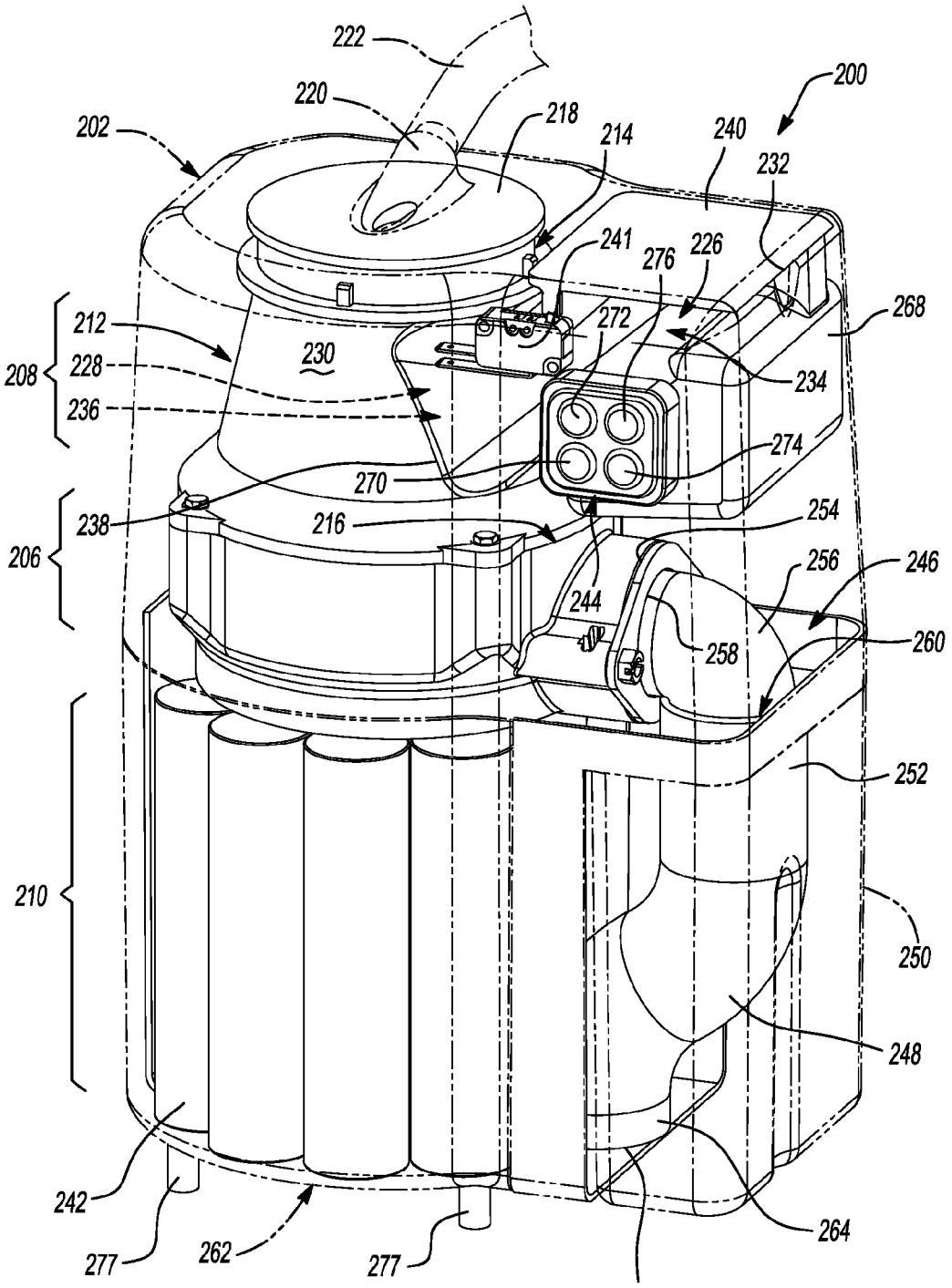
FIG. 2. is a perspective view of a countertop food waste disposer in accordance with an aspect of the present disclosure.

In FIG. 2, a counter top food waste disposer 200 in accordance with an aspect of the present disclosure is shown. Counter top food waste disposer 200 may in an illustrative embodiment be a modification of food waste disposer 10. Food waste disposer 200 includes a grind and discharge section 206 disposed between a food conveying section 208 and a motor section 210. A housing 202 surrounds grind and discharge section 206, conveying section 208 and motor section 210. Housing 202 is shown as translucent so that sections of food waste disposer 200 can be seen. Grind and discharge section 206 may illustratively include grind section 14 (FIG. 1), discharge section 15 (FIG. 1) and grind mechanism 19 (FIG. 1). Motor section 210 may illustratively include motor 34 (FIG. 1). Food conveying section 208 illustratively has a frusto-conical housing 212 having an upper truncated apex end 214 and a lower base end 216. Lower base end 216 has a larger diameter than upper apex end 214. In an aspect, lower base end 216 flares outwardly as shown in FIG. 2. It should be understood that housing 212 can have other than a frusto-conical shape. Housing 212 may, for example, have a cylindrical shape.

Upper end 214 of housing 212 has a top cover 218 covering upper end 214 so that upper end 214 is closed except for hose coupling 220 to which a hose 222 is removably couplable. Hose coupling 220 projects outwardly from top cover 218 and also opens into an interior of housing 212.

A bottom 262 of housing 202 illustratively includes feet 277. Feet 277 can either be molded into the bottom 262 of housing 202 or can be separate rubber or plastic components affixed to the bottom 262 of housing 202.

A food waste inlet chute 226 projects upwardly and outwardly from an inlet opening 228 in a sidewall 230 of housing 212 of food waste disposer 200. Food waste inlet chute 226 has an inlet 232 at an outer end 234 and an outlet 236 at an inner end 238 that opens into an interior of housing 212 through inlet opening 228 in sidewall 230 of housing 212. A cover 240 is disposed over inlet 232 of food waste inlet chute. In an illustrative embodiment, cover 240 may be a hinged cover. In an illustrative embodiment, housing 212 and food waste inlet chute 226 are integral with each other, such as being formed as a molded plastic component.

A battery pack 242 is coupled to food waste disposer 200 to provide power to motor 34. Illustratively, motor 34 of food waste disposer 200 is a DC motor. Battery pack 242 is may illustratively be coupled to motor 34 through control panel 244. Battery pack 242 may be by way of example a removable battery pack, and may illustratively be a rechargeable battery pack and may illustratively be a lithium ion rechargeable battery pack.

Food waste disposer 200 includes a discharge area 246 adapted to receive a container 250 therein, which is removably receivable in discharge area 246. By way of example and not of limitation, discharge area 246 is adapted to received container 250 by being sized so that container 250 fits therein. This also allows discharge area to receive a hose 248, which is removably receivable in discharge area 246. When hose 248 is in place in discharge area 246, container 250 is not. Hose 248 has an upper end 252 removably couplable to a discharge outlet 254 of grind and discharge section 206, illustratively by a coupling 256. In this embodiment, coupling 256 has an inlet end 258 affixed to discharge outlet 254 and upper end 252 of hose 248 is placed over an outlet end 260 of coupling 256. Illustratively, upper end 252 of hose 248 is held in place on outlet end 260 of coupling 256 by friction. It should be understood that upper end 252 of hose 248 could also be secured to outlet end 260 such as by a hose clamp (not shown). Coupling 256 may be a right angle pipe elbow so that outlet end 260 opens downwardly.

Figure 3:
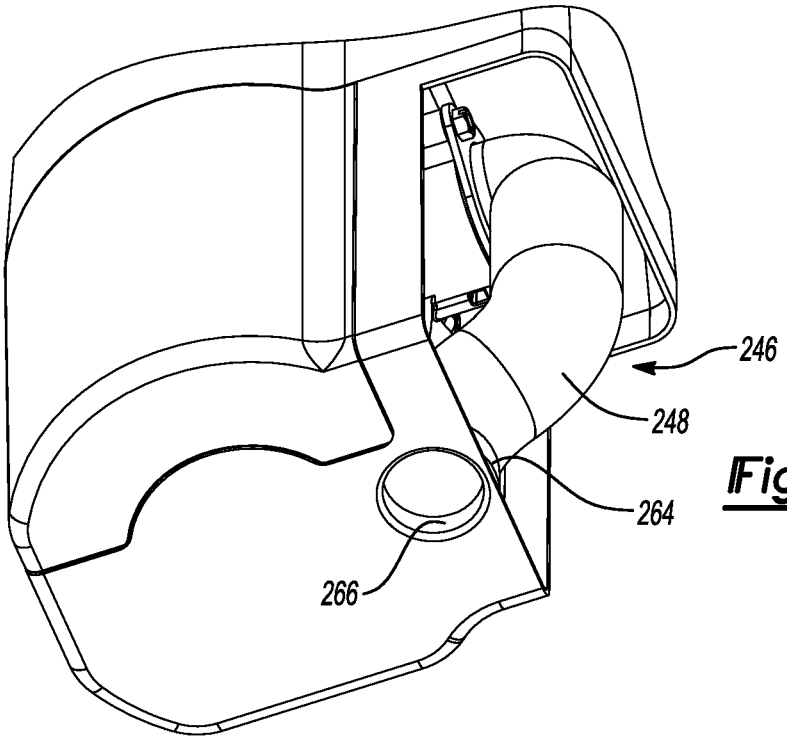
FIG. 3 is a perspective view of a portion of the countertop food waste disposer of FIG. 2 showing a hose in place in a discharge area of the countertop food waste disposer.

When hose 248 is received in discharge area 246 with upper end 252 coupled to discharge outlet 254 such as by coupling 256, hose 248 extends downwardly to bottom 262 of housing 202 of food waste disposer 200 through at least a portion of the discharge area 246 and has a lower end 264 at or near the bottom 262 of food waste disposer 200. In an aspect, bottom 262 of housing 202 includes a discharge outlet 266 (best shown in FIG. 3) to which lower end 264 of hose 248 is coupled.

In an aspect, a water reservoir 268 (FIG. 2) is affixed to food waste inlet chute 226. In a mode of operation described in more detail below, a water metering mechanism 500 (FIG. 5) is adapted to meter water from water reservoir 268 into food waste inlet chute 226 during operation of food waste disposer 200. It should be understood that the water metering mechanism 500 could meter water directly into food conveying section 208, grind section 14 of grind and discharge section 206 or into food waste inlet chute 226. The water metering mechanism 500 may for example include a controlled valve that meters water.

Figure 5:
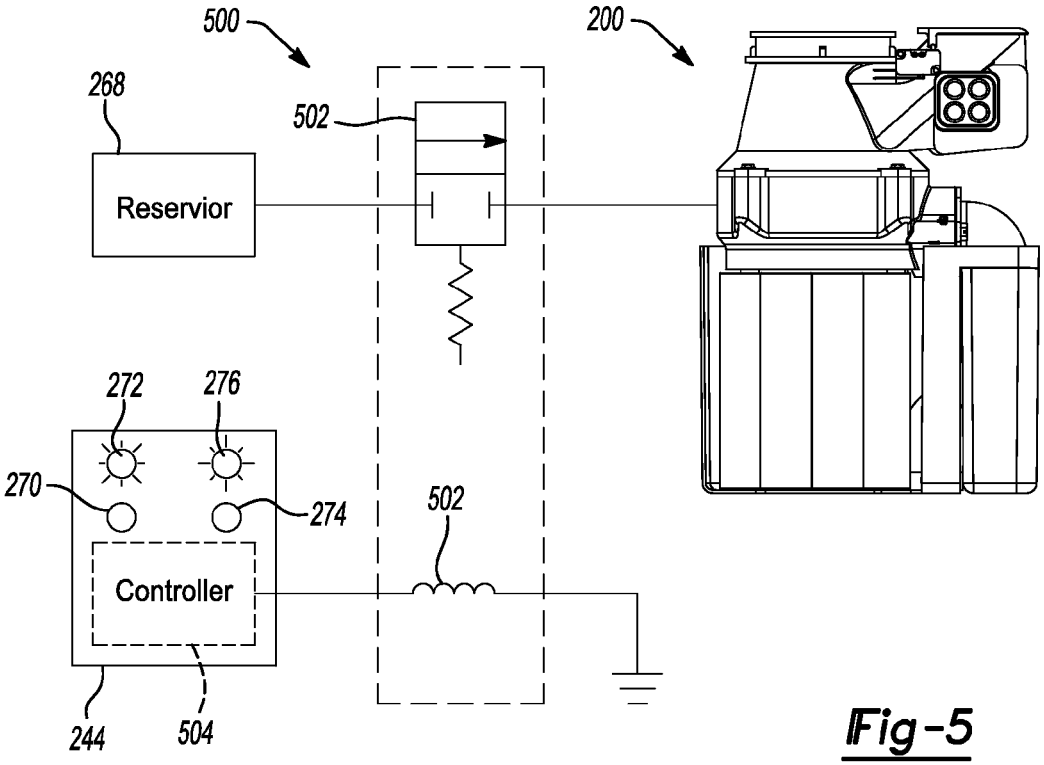
FIG. 5 is a simplified schematic showing a water metering mechanism of the countertop food waste disposer of FIG. 2.
Figure 6:
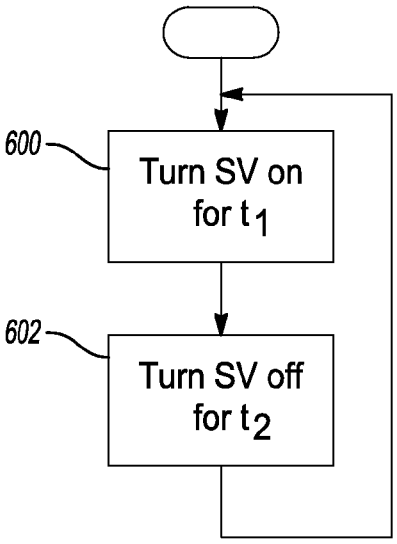
FIG. 6 is a simplified flow chart showing a control of the water metering mechanism of FIG. 5.

With reference to FIGS. 5 and 6, an example of a water metering mechanism 500 is described. Water metering mechanism 500 includes a solenoid valve 502 under control of a controller 504, which may illustratively be disposed in control panel 244. With reference to FIG. 6, controller 504 controls solenoid valve 502 to meter water into food waste disposer 200 by turning solenoid valve 502 on for a period of time at 600, then turning it off for a period of time at 602 and then repeating the cycle if needed. It should be understood that water metering mechanism 500 could be water meter mechanisms other than that described in FIGS. 5 and 6. It should also be understood that controller 504 controls lights 272, 276.

Food waste disposer 200 includes two basic modes of operation. In first mode, similar to the way in which food waste disposers typically operate, hose 248 is in place in discharge area 246. Food waste disposer 200 is placed in a sink. Preferably, food waste disposer 200 is positioned in sink so that lower end 264 of hose 248 is over a drain opening of the sink. If bottom 262 of housing 202 includes discharge outlet 266, food waste disposer 200 is placed in the sink so that discharge outlet 266 is over the draining opening. Feet 277 keep the bottom 262 of housing 212 off a bottom of a sink when food waste disposer 200 is placed in the sink. Hose 222 is coupled to a faucet (not shown) which is turned on to introduce water into food conveying section 208. It should be understood that alternatively, cover 240 can include openings, such as slots, so that water can be introduced directly from a faucet of the sink. Food waste is placed in food waste inlet chute 226 and cover 240 closed. Cover 240 at inlet 232 of food waste inlet chute 226 has an interlock 241 to prevent access to food waste inlet chute 226 when motor 34 of food waste disposer 200 is running. An "on" button 270 of control panel 244 is pressed. A light 272 (illustratively a Green light) above On button 270 then lights. On button 270 is then pressed again and assuming cover 240 is closed, food waste disposer 200 turns on and motor 34 begins rotating. Comminuted food waste is discharged through hose 248 into the drain opening of the sink. Light 272 will flash until controller 504 of food waste disposer 200 senses that the grind cycle is complete which then turns food waste disposer 200 off, such as by turning motor 34 off. Light 272 then goes back to a solid color for three seconds.

If metered water is desired, a user presses both on button 270 and a water button 274 of control panel 244. Water is then introduced into grind section 14 (directly or indirectly such as through food waste inlet chute 226) of food waste disposer 200 from water reservoir 268. A light 276 (illustratively a Blue light) of control panel 244 above water button 274 is illuminated, such as by flashing, while motor 34 of food waste disposer 200 is running and goes out when food waste disposer 200 is turned off when the grind cycle is complete.

Figure 4:
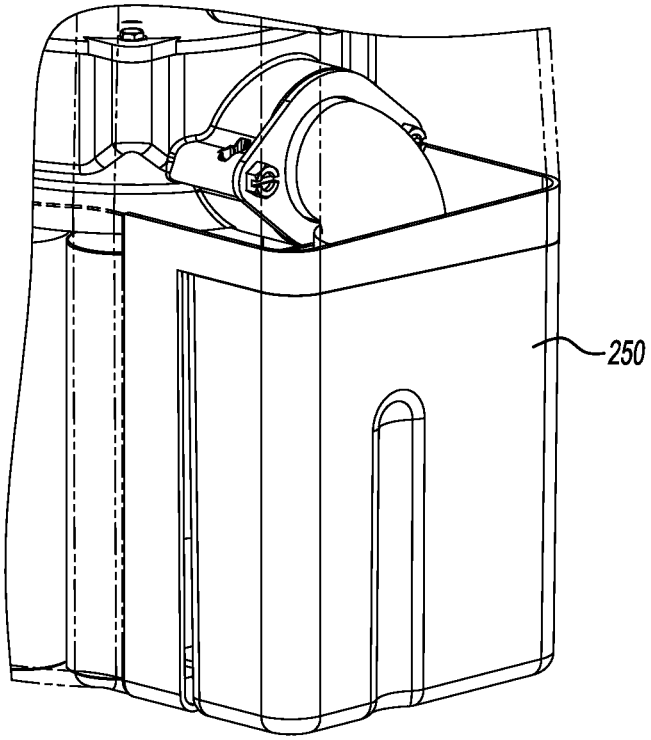
FIG. 4 is a perspective view of a portion of the countertop food waste disposer of FIG. 2 showing a container in place in a discharge area of the countertop food waste disposer.

The second mode of operation of food waste disposer 200 is for self-composting. Hose 222 is not connected to the faucet. Container 250 is placed in discharge area 246 as shown in FIG. 4 instead of hose 248. As before, the food waste is placed in food waste inlet chute 226 and cover 240 closed. On button 270 is pressed and comminuted food waste is discharged from discharge outlet 254 of grind and discharge section 206 into container 250. Metered water can be used as discussed above. The comminuted food waste discharged into container 250 can then be composted, such as by emptying container 250 into a composting pile.

Control circuit 504 may be or include a digital processor (DSP), microprocessor, microcontroller, or other programmable device which are programmed with software implementing the above described control of food waste disposer 200. It should be understood that other logic devices can be used, such as a Field Programmable Gate Array (FPGA), a complex programmable logic device (CPLD), or application specific integrated circuit (ASIC). When it is stated that controller 504 performs a function or is configured to perform a function, it should be understood that controller 504 is configured to do so with appropriate logic (software, hardware, or a combination of both), such as by appropriate software, electronic circuit(s) including discrete and integrated logic, or combination thereof.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention.

What is claimed is:

1. A counter top food waste disposer, comprising:

a food conveying section, a motor section and a grind and discharge section disposed between the food conveying section and the motor section, the grind and discharge section having a grind section and a discharge section;

the grind section including a grind mechanism with a stationary grind ring and a rotating shredder plate assembly, the rotating shredder plate assembly including a rotatable shredder plate on which lugs are fastened, the grind section including a grind housing that encompasses the grind mechanism and holds the stationary grind ring;

the food waste disposer having a first mode of operation in which food waste is discharged out of the food waste disposer from the discharge section and a second mode of operation in which food waste is discharged into a container received in a discharge area of the food waste disposer; and the discharge area configured to removably receive a hose and removably receive the container wherein the hose is removably received in the discharge area for the first mode of operation with an upper end of the hose coupled to a discharge outlet of the discharge section and food waste is dischargeable during operation of the food waste disposer in the first mode of operation from the discharge outlet and out through the hose and the container is removably received in the discharge area for the second mode of operation and during operation of the food waste disposer in the second mode of operation food waste is dischargeable from the discharge outlet of the discharge section into the container.

2. The counter top food waste disposer of claim 1, further including a food waste inlet chute projecting from a housing of the food conveying section of the food waste disposer and having an outlet opening to the food conveying section.

3. The counter top food waste disposer of claim 2, further including a water reservoir from which water is introducible into the food waste disposer and a water metering mechanism coupled to the water reservoir, the water metering mechanism configured to meter water from the reservoir into the food waste disposer.

4. The counter top food waste disposer of claim 3 wherein the water is introduced into the food conveying section when the water is introduced into the food waste disposer.

5. The counter top food waste disposer of claim 1 and further including a battery pack and the motor section including a motor that is powered by the battery pack.

6. The countertop food waste disposable of claim 1 including a coupling having an inlet end affixed to the discharge outlet of the discharge section and an outlet end over which the upper end of the hose is placeable.

* * * * *